US007620194B2

(12) United States Patent
Sayler et al.

(10) Patent No.: US 7,620,194 B2
(45) **Date of Patent: *Nov. 17, 2009**

(54) DIGITAL HEARING AID BATTERY CONSERVATION METHOD AND APPARATUS

(76) Inventors: John H. Sayler, 519 Glendale Cir., Ann Arbor, MI (US) 48103; Bernard A. Galler, 1056 Ferdon Rd., Ann Arbor, MI (US) 48104

( * ) Notice: Subject to any disclaimer, the term of this patent is extended or adjusted under 35 U.S.C. 154(b) by 101 days.

This patent is subject to a terminal disclaimer.

(21) Appl. No.: 11/558,106

(22) Filed: Nov. 9, 2006

(65) Prior Publication Data

US 2007/0195980 A1 Aug. 23, 2007

Related U.S. Application Data

(63) Continuation of application No. 10/646,541, filed on Aug. 21, 2003, now Pat. No. 7,151,838.

(60) Provisional application No. 60/404,949, filed on Aug. 21, 2002.

(51) Int. Cl.
*H04R 25/00* (2006.01)

(52) U.S. Cl. ..... 381/312; 381/323

(58) Field of Classification Search ..... 381/312, 381/323

See application file for complete search history.

(56) References Cited

U.S. PATENT DOCUMENTS 4,887,299 A * 12/1989 Cummins et al. ..... 381/317
5,111,419 A 5/1992 Morley, Jr. et al.
5,111,506 A 5/1992 Charpentier et al.
5,500,902 A 3/1996 Stockham, Jr. et al.
5,719,528 A 2/1998 Rasmussen et al.
5,757,932 A 5/1998 Lindemann et al.
6,516,073 B1 * 2/2003 Schulz et al. ..... 381/312
6,711,271 B2 3/2004 Hou
6,754,355 B2 6/2004 Stetzler et al.
6,885,752 B1 4/2005 Chabries et al.
6,914,994 B1 7/2005 Shennib et al.
7,151,838 B2 * 12/2006 Galler et al. ..... 381/312

OTHER PUBLICATIONS

Advanced IC Technology, "System-on-Chip Solutions for Next-Generation Medical Applications", Fall 2003.
EE Times, "Hearing-aid SoC: Tiny Gear, Big Challenges", Mar. 17, 2004.

(Continued)

*Primary Examiner*—Walter F Briney, III
(74) *Attorney, Agent, or Firm*—Harness, Dickey & Pierce, PLC

(57) ABSTRACT

A digital hearing aid adjusts power to a processor or other modules to conserve battery life. The digital hearing aid receives and measures audio signals from an environment. If a magnitude of the audio signals is less than a predetermined threshold, the digital hearing aid starts a timer. If the audio signals are below the threshold for a predetermined period as measured by the timer, the digital hearing aid adjusts power to the processor or other modules. The digital hearing aid may also adjust clock rates and sampling rates of the processor. If the digital hearing aid detects audio signals above the threshold, the digital hearing aid restores power to the processor or other modules.

20 Claims, 3 Drawing Sheets

OTHER PUBLICATIONS

IP 2000 Conference Oct. 23-24, 2000, "Lower Power Macro Component Library Framework for the Design and Verification of DSP IPs for Hearing Aid Applications", Oct. 23-24, 2000.

1997 Microchip Technology Inc., Section 26, Watchdog Timer and Sleep Mode.

Maxstream. Knowledgebase, "Cyclic Sleep Mode Example".

EE Times. "Designing Ultra-Low-Power DSPs", Jan. 30, 2001.

AMIS Press Release, Apr. 2005, Phonak selects BelaSigna 200. Sumo hearing aids.

Texas Instruments, "Digital Hearing Aids: Overview".

CSE—Department of Computer Science and Technology, Washington University in St. Louis, "Power Consumption of Digital Hearing Aid Computations Using Customized Numerical Representations".

* cited by examiner

DIGITAL HEARING AID BATTERY CONSERVATION METHOD AND APPARATUS

CROSS-REFERENCE TO RELATED APPLICATIONS

This application is a continuation of U.S. patent application Ser. No. 10/646,541 filed on Aug. 21, 2003 now U.S. Pat. No. 7,151,838, which claims priority to Provisional Application No. 60/404,949 filed Aug. 21, 2002. The disclosure of the above applications is incorporated herein by reference.

FIELD OF THE INVENTION

The present invention relates to digital hearing aids, and more particularly to prolonging the battery life of digital hearing aids.

BACKGROUND OF THE INVENTION

A significant disadvantage of digital hearing aid devices is the relatively short battery life. Typically, the battery life of a digital hearing aid is a week or ten days. Therefore, devices may use various methods to conserve battery life. One method conserves battery life by detecting when the wearer sleeps at night. The device reduces the amount of energy consumed by the processor in such circumstances. However, this method does not take into consideration situations where the wearer is awake but there is no discernable sound to be processed by the device. The above method is not designed to cease processor and clock functions at any time, day or night, when the decibel level is low enough that the wearer doesn't need to be aware that a particular sound has occurred.

However, a digital hearing aid device must awaken quickly enough when a noteworthy sound occurs. Ideally the performance of the device from the point of view of the wearer should not be degraded. Examples of this kind of device behavior can be found in cardiac pacemakers. Pacemaker designers emphasize the need for the processor to go to sleep in order to conserve battery life, since surgery may be necessary if the battery has to be replaced in a pacemaker. This extreme requirement is not needed in a hearing aid device, since the battery is easily replaced. However, the remarkably short life of batteries in existing hearing aid devices results in consumer frustration, as well as unnecessary expense and inconvenience.

SUMMARY OF THE INVENTION

A digital hearing aid for conserving a life of a battery comprises an audio input device that receives audio signals from an environment. A processor processes the audio signals. An audio amplification circuit outputs the audio signals. A controller communicates with the audio input device, the processor, and the audio amplification circuit and determines a magnitude of the audio signals. The controller adjusts parameters of at least one of the processor and the audio amplification circuit if the magnitude of the audio signals is less than a predetermined threshold for a first period.

In another aspect of the invention, a method for conserving a life of a battery in a digital hearing aid comprises detecting audio signals in an environment. A magnitude of the audio signals is measured. The magnitude is compared to a predetermined threshold. Power to one or more modules residing on the digital hearing aid is reduced if the magnitude is less than the threshold for a first period. Power to the one or more modules is restored if the magnitude is greater than or equal to the threshold.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses.

Figure 1:
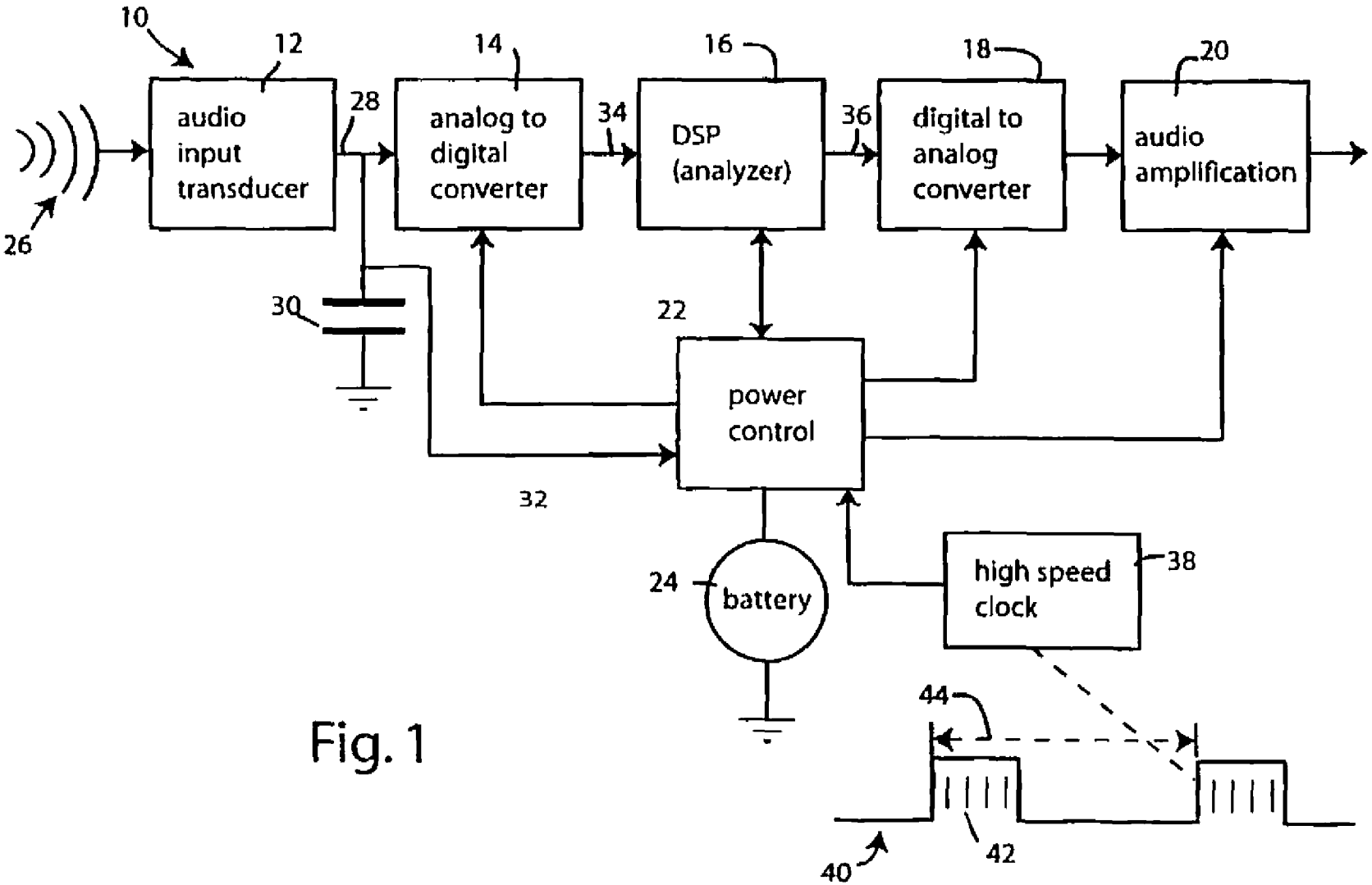
FIG. 1 is a functional block diagram of an exemplary hearing aid device according to the present invention.

Referring now to FIG. 1, a digital hearing aid (DHA) control circuit 10 is shown. The control circuit 10 includes a audio input transducer 12, an analog-to-digital (A/D) converter 14, a digital signal processor (DSP) 16, a digital-to-analog (D/A) converter 18, and an audio amplification circuit 20. A power control circuit 22 controls power delivery from a battery 24 to the control circuit 10. The power control circuit 22 conserves life of the battery 12 by optimizing power to the DSP 16. Alternatively, the power control circuit 22 may control the power to the control circuit 10 in totality.

Sound 26 is input through the audio input transducer 12 of the DHA control circuit 10, producing a fluctuating voltage or current signal 28 at the output of the transducer 12. In a presently preferred embodiment, an analog integrator circuit 30 monitors this fluctuating voltage or current signal 28 to produce a power control logic signal 32 that switches the power to the remainder of the circuit "on" and/or "off", as will be discussed below. The parameters of the analog integrator circuit 30 are selected to provide a reliable indication that an "interesting" sound is present in the sound field. For the purpose of the present invention, sounds that are determined to be at or above a particular threshold are hereinafter referred to as "interesting." Audio signals that are determined to be below the threshold are referred to as "uninteresting." The analog integrator 30 can be constructed using a small capacitor or other energy storage device to generate an average sound input signal over a suitable time frame or sampling window. By integrating over a suitable period, the circuit ignores short transient spikes but allows a sustained input sound above a predetermined decibel level to turn power on. In alternative embodiments, the sound level may be measured at different locations. For example, the sound level may be measured at the output of the DSP 16. In another embodiment, the power control circuit 22 includes a comparator that compares the logic signal 32 to the predetermined threshold.

The audio input transducer 12 is also coupled to the A/D converter 14, which samples the fluctuating voltage or current signal 28 to produce a digital signal 34 that is fed to the DSP 16. The DSP 16 performs sophisticated signal processing upon the digital signal 34, based on digital parameters set by an audiologist to suit the particular user's hearing aid requirements. The DSP 16 supplies the processed signal 36 to the D/A converter 18, which in turn feeds the analog audio amplification circuit 20 that drives a hearing aid output transducer or speaker.

It is estimated that approximately half of the energy consumed by the digital hearing aid is consumed by the analog audio amplification circuit 20 and much of the remainder is consumed by the DSP 16 and converter stages 14 and 18. The invention conserves battery power by selectively switching these power-consuming components off when there is no "interesting" sound present in the sound field. In one embodiment, the DSP 16 detects when the input information drops below or falls outside the "interesting" level or range. In another embodiment, the analog integrator circuit 30 performs this function. When the input sound 26 is determined not to be "interesting" by the DSP 16, the analog audio amplification circuit 20 and the converter stages 14 and 18 are switched off by sending a suitable "off" signal to the power control circuit 22. These circuits remain off until the analog integrator circuit 30 detects an "interesting" sound and produces its power control logic signal 32 to switch the power control circuit 22 back on.

Thus the analog integrator circuit 30 functions as a power control component that mediates how power may be consumed by the digital stages and by the audio amplification stages. While use of an analog integrator is presently preferred, another embodiment can be constructed by using the output of the analog input transducer 12 directly to supply the logic signal 28 to the power control circuit 22. In such an embodiment the instantaneous sound signal is used to determine when power is switched on and/or off.

In another, more sophisticated, embodiment a high-speed clock 38 is added to the power control circuit 22. The clock 38 may be configured to operate at a substantially higher clock rate than is required by the sampling systems of the A/D converter 14 and DSP 16. The power control circuit 22 uses this higher clock rate to mediate when the A/D converter 14, DSP 16, D/A converter 18, and amplification 20 circuits are switched on and off. Much power can be saved by switching these circuits off during a substantial portion of the time, even when an "interesting" sound is detected as present.

For example, assume that the DSP 16 is designed to operate upon signals in a frequency range from 20 Hz. to 12 kHz. This dictates that the sampling frequency should be 24 kHz (twice the upper frequency limit). Assume that a DSP algorithm requires one hundred samples to perform frequency domain calculations needed to effect the desired frequency curve fitting algorithm (this is merely an example, used to illustrate the concept of the invention). To obtain the required number of samples, only a few milliseconds of data must be captured each second. For example, a clock signal 40 includes a sampling window 42. The duration of the sampling window 42 may be a relatively small portion of a second, as indicated by a period 44. Using the power control circuit 22, which clocked at a much higher frequency (e.g. 100 kHz. or 1 MHz.), the digital components of the DHA control circuit 10 can be switched off most of the time. The duty cycle of on-time to off-time will depend on the requirements of the DSP algorithm, but in most cases the digital circuitry and amplification circuitry can be switched off for a large percentage of the time during each second.

This high speed switching embodiment, in effect, multiplexes the digital hearing aid circuitry between two states: a power-saving state and a sound-processing state. For maximum battery life, the power-saving state can be configured to switch off all unnecessary components (e.g., the DSP 16, the converter circuits 14 and 18, and the amplification circuit 20). Alternatively, all or a portion of the power-saving state can be used to perform other less processor-intensive tasks, such as performing system housekeeping functions such as updating values of ambient noise conditions for use by later processing operations.

While the power control circuit 22 of the presently preferred embodiment is designed to switch power off to components when they are not needed, other embodiments are also envisioned. For example, instead of cutting power altogether, the power control component can switch the clock rate of the converters 14 and 18 and the DSP 16 to a lower speed. This will save energy while allowing those devices to remain operational. In this low clock mode the circuits are still available to perform processing tasks, although they will do so more slowly than when clocked at full speed. It is to be understood that any component of the DHA control circuit 10, including but not limited to processing functions, clock and timer functions, and power control functions, may be provided as components that are external to the DHA.

Figure 2:
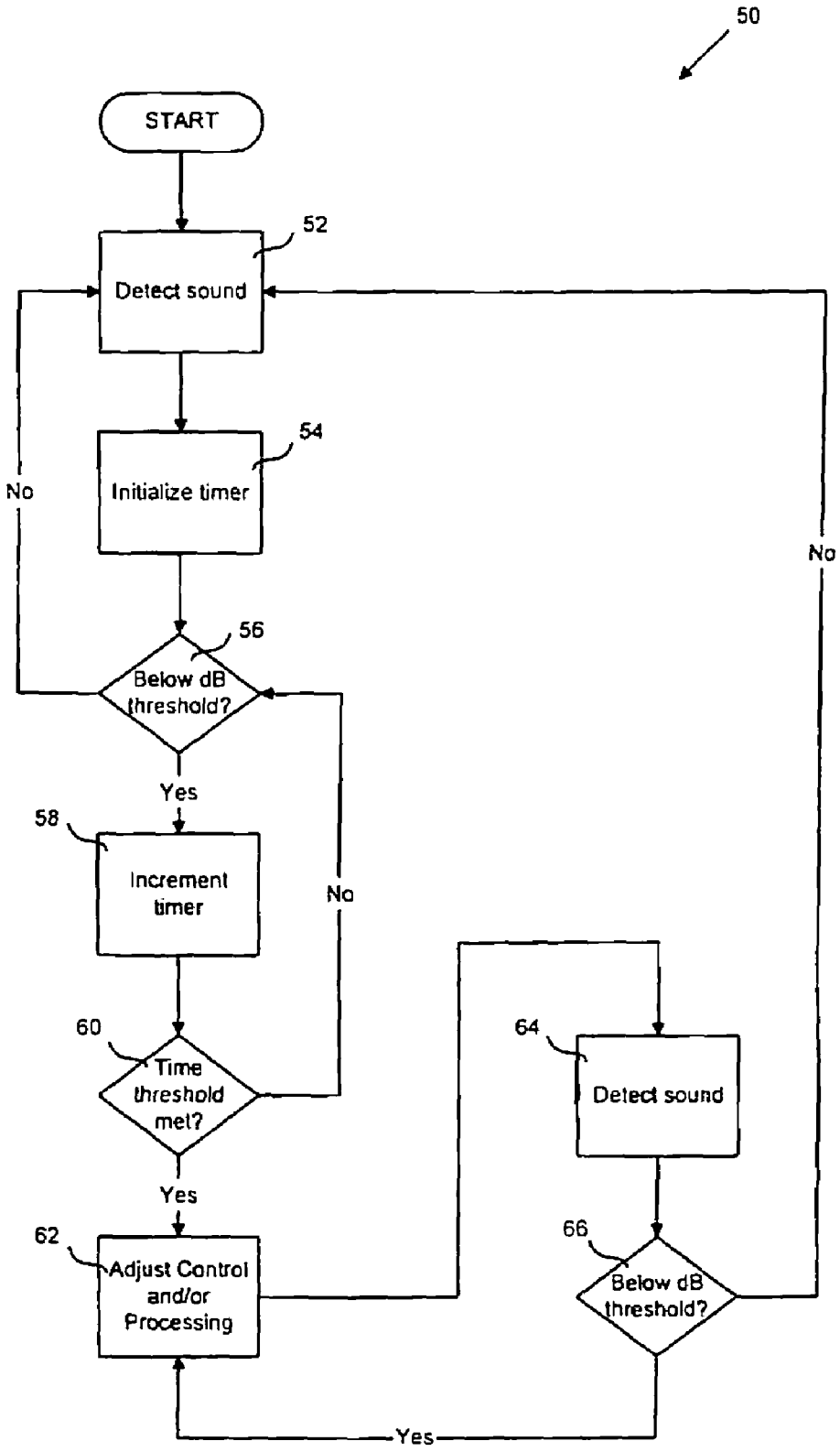
FIG. 2 is a flow diagram of a hearing aid device according to the present invention.

Referring now to FIG. 2, an exemplary flow diagram 50 of the DHA control circuit is described. At step 52, the DHA control circuit detects and processes sound. During standard processing of a detected sound, a timer may be initialized and/or reinitialized at step 54. The timer may be internal or external to the DHA control circuit. The DSP or analog integrator circuit then determines whether the detected sound is at or above a decibel threshold at step 56. If the decibel level is at or above the threshold, the process returns to step 52 to continue detecting and processing sound.

If the detected sound is below the threshold, the timer is incremented at step 58. It is also understood that the timer may begin at a high value and decrement to zero. The DHA control circuit determines whether the timer has reached a predetermined value at step 60. In other words, the DHA determines if the detected sound has been below the threshold for a predetermined period. When this condition is met, the DHA control circuit adjusts the operation of components such as the DSP, converters, and amplification circuit at step 62. For example, the DHA control circuit may turn of power to the converters, the DSP, and the amplification circuit. In another embodiment, the DHA control circuit my adjust the clock speeds and/or sampling rates of the DSP, converters, and amplification circuit.

The DHA control circuit continues to detect sound at step 64. The DHA control circuit determines whether the detected sound is above the decibel threshold at step 66. If the detected sound is still below the threshold, the DHA control circuit continues to operate as indicated by step 62. Otherwise, the DHA returns to normal operation at step 52.

Figure 3:
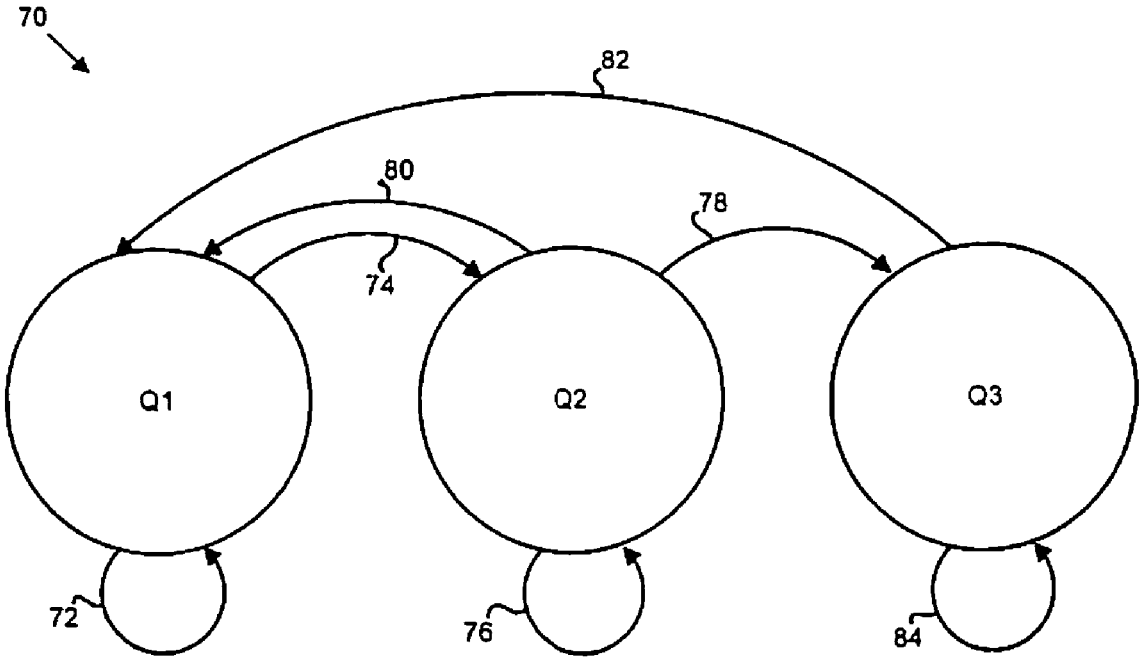
FIG. 3 is a state transition diagram of a hearing aid device according to the present invention.

Referring now to FIG. 3, a state diagram 70 of an exemplary DHA is shown. In state Q1, the DHA receives and processes sounds from an environment. The DHA samples the sounds and determines if the sounds at a particular instance are above a threshold. The DHA samples the sounds at a predetermined sampling rate. Alternatively, the sampling rate may be adjustable. If a sound is determined to be "interesting" while the DHA is in state Q1, the DHA remains in state Q1, as indicated by transition 72. If a sound is determined to be "uninteresting" while the DHA is in state Q1, the DHA moves to state Q2, as indicated by transition 74.

In state Q2, the DHA determines whether or not to adjust operations of components such as the DPS, converters, and amplification circuit. The DHA initializes a timer to a time T1. The timer may be predetermined by a manufacturer or adjustable by a user. Once the timer initializes at the time T1, the timer begins to decrement. The DHA remains in state Q2 as long as T1 is greater than zero and the DHA does not detect an "interesting" sound, as indicated by transition 76. If the timer reaches a time of zero without being interrupted by an "interesting" sound, the DHA moves to state Q3 as indicated by transition 78. If the DHA detects an "interesting" sound while in state Q2, the DHA returns to state Q1 as indicated by transition 80.

In state Q3, the DHA adjusts operational parameters. For example, referring back to FIG. 1, the power control circuit 22 may turn off power to the converters 14 and 18, the DSP 16, and the amplification circuit 20. In another embodiment, the power control circuit 22 may only turn off power to the amplification circuit 20. In another embodiment, the DSP 16 may alter the manner in which audio signals are processed. For example, the power control circuit 22 may provide power to the DSP 16 according to the high speed clock 40. In this manner, the DSP 16 will only process audio signals for a fraction of a second to conserve power. Because the DSP 16 would only process signals for a fraction of a second, only select portions of the sound may be passed on to a user. However, the relatively brief "off" periods would cause little or no degradation of sound to the perception of the user. In still another embodiment, the power control circuit 22 may provide power to the DSP 16 and other components according to the clock 40 during "normal" operation. If the DHA control circuit determines that a sound is "interesting," the DHA returns to state Q1 as indicated by transition 82. If the DHA control circuit fails to detect an "interesting" sound, the DHA remains in state Q3 as indicated by transition 84.

Additionally, the present invention may include various embodiments for presetting and/or adjusting parameters of the DHA control circuit. For example, the DHA may include an interface through which a user may preset and/or adjust the parameters. In one embodiment, a user or technician may adjust and/or preset clock rates, sampling rates, one or more timers, or the "interesting/uninteresting" threshold. Clocks rates may include a DHA internal clock, the high speed clock of the power control circuit, or a clock external to the DHA. The technician may also select which parameters are adjustable by a user. The interface may include mechanisms such as thumbwheels or setscrews. Alternatively, the user or technician may use a remote device or an external computer to adjust parameters.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. In a hearing aid, the improvement comprising:

a processor that operates in accordance with a clock signal and adapted to handle plural processes;

said plural processes including a first process that operates upon audio signals received from the environment, wherein the first process operates with a sampling window consisting of samples at a uniform rate;

said plural processes including a second process that differs from said first process; and a switcher that causes said processor to multiplex between said plural processes within a period of the clock signal, wherein, during multiplexing between said plural processes, the switcher causes the duty cycle of the sampling window of the first process to decrease below unity.

2. The improvement of claim 1 wherein said second process consumes less power than said first process.

3. The improvement of claim 1 wherein said second process operates upon information using a data format that differs from that of said first process.

4. The improvement of claim 3 wherein the data format of said first process is a digital audio format and wherein the protocol of said second process is a control parameter format.

5. The improvement of claim 4 wherein said control parameter format embodies a representation of ambient noise conditions.

6. The improvement of claim 1 wherein said second process operates upon information using a protocol that differs from that of said first process.

7. The improvement of claim 6 wherein the protocol of said first process is a digital audio processing protocol and wherein the protocol of said second process is a control parameter protocol.

8. The improvement of claim 1 wherein said first process is a first digital audio signal process and wherein said second process is a digital audio signal process that differs from said first digital audio signal process.

9. The improvement of claim 8 wherein said first digital audio signal process and said second digital audio signal process are at different clock rates.

10. The improvement of claim 1 wherein the audio signal are sampled at a frequency substantially higher than frequency of the clock signal.

11. A method of operating a hearing aid comprising:

operating a processor of a hearing aid in accordance with a clock signal;

switching the processor of a hearing aid to perform a first process within a given duration of the clock signal, where the first process operates upon audio signals within a sampling window consisting of samples; and multiplexing said processor to periodically performing a second process within the given duration of the clock signal, where the second process differs from said first process and the duty cycle of the sampling window in relation to the given duration is less than unity.

12. The method of claim 11 wherein said second process consumes less power than said first process.

13. The method of claim 11 wherein said second process operates upon information using a data format that differs from that of said first process.

14. The method of claim 13 wherein the data format of said first process is a digital audio format and wherein the protocol of said second process is a control parameter format.

15. The method of claim 14 wherein said control parameter format embodies a representation of ambient noise conditions.

16. The method of claim 11 wherein said second process operates upon information using a protocol that differs from that of said first process.

17. The method of claim 16 wherein the protocol of said first process is a digital audio processing protocol and wherein the protocol of said second process is a control parameter protocol.

18. The method of claim 11 wherein said first process is a first digital audio signal process and wherein said second process is a digital audio signal process that differs from said first digital audio signal process.

19. The method of claim 18 wherein said first digital audio signal process and said second digital audio signal process are at different clock rates.

20. In a hearing aid, the improvement comprising:

a processor that operates in accordance with a clock signal and adapted to handle plural processes;

said plural processes including a first process that operates upon audio signals received from the environment, wherein the first process operates with a sampling window consisting of samples;

said plural processes including a second process that differs from said first process; and a switcher that causes said processor to multiplex between said plural processes within a duration of the clock signal, wherein during multiplexing between said plural processes the switcher causes the duty cycle of the sampling window of the first process to decrease below unity.

* * * * *